United States Patent [19]

van Dee

[11] 4,326,346

[45] Apr. 27, 1982

[54] CRANE FOR A TOWING SUCTION DEVICE FOR A DREDGING CRAFT

[75] Inventor: Nicolaas F. van Dee, Santpoort, Netherlands

[73] Assignee: B.V. Beheermaatschappij T. denBreejen van den Bout, Overveen, Netherlands

[21] Appl. No.: 128,389

[22] Filed: Mar. 10, 1980

[30] Foreign Application Priority Data

Mar. 11, 1979 [NL] Netherlands ..... 7901935

[51] Int. Cl.³ ..... E02F 3/90

[52] U.S. Cl. ..... 37/72; 212/252; 114/374

[58] Field of Search ..... 37/72, 58; 212/232, 212/252, 255, 261, 266, 190, 192; 9/39, 35, 38; 254/361, 315; 242/84.1 A

[56] References Cited

U.S. PATENT DOCUMENTS

| | | | |
|---|---|---|---|
| 382,307 | 5/1888 | Huth | 212/252 X |
| 689,642 | 12/1901 | Fannon | 212/252 |
| 2,828,867 | 4/1958 | Frisk | 212/252 X |
| 4,185,520 | 1/1980 | Henneman et al. | 254/361 X |

FOREIGN PATENT DOCUMENTS

| | | | |
|---|---|---|---|
| 651760 | 10/1937 | Fed. Rep. of Germany . | |
| 1199460 | 8/1959 | Fed. Rep. of Germany | 212/252 |
| 1108104 | 5/1961 | Fed. Rep. of Germany | 9/39 |
| 2118611 | 11/1971 | Fed. Rep. of Germany | 9/35 |
| 2129120 | 12/1971 | Fed. Rep. of Germany | 9/35 |
| 54745 | 6/1943 | Netherlands | 37/72 |
| 297963 | 11/1965 | Netherlands . | |
| 7708953 | 2/1979 | Netherlands . | |
| 7710497 | 3/1979 | Netherlands . | |
| 304543 | 1/1929 | United Kingdom | 37/72 |
| 1557596 | 12/1979 | United Kingdom . | |

*Primary Examiner*—Clifford D. Crowder

*Attorney, Agent, or Firm*—Andrus, Sceales, Starke & Sawall

[57] ABSTRACT

Crane for a towing suction device of a dredging craft, which crane is provided with a carrying arm with which a movable tube part of the towing suction device can be displaced between an inboard non-operative or rest position and an outboard dredging position, with which at least one power driven winch is arranged for hoisting and/or paying out one or more cables connected with the movable tube part, the winch with its motor being housed inside a closed tube shaped part of the carrying arm, said winch motor being placed coaxially at the inside of the winch, whereas the winch cables also extend at least partly through the tube shaped carrying arm.

7 Claims, 2 Drawing Figures

CRANE FOR A TOWING SUCTION DEVICE FOR A DREDGING CRAFT

BACKGROUND OF THE INVENTION

The invention relates to a crane for a towing suction device of a dredging craft, which crane comprises a carrying arm, with which a movable tube part of the towing suction device can be displaced between an inboard rest position and an outboard dredging position, with which at least one power driven winch has been arranged for hoisting and/or paying out one or more cables that are connected with the movable tube part.

A crane of this type is known from practice. With this one the suction mouth that is mounted at the bottom of the movable tube part of the towing suction device is brought on the bottom of the water, that has to be dredged out with towing suction. Usually the operating winch with its drive motor is mounted open on deck, or possibly mounted on the outside of the crane. This has the objection, that with a dredging craft, of which the deck is very often covered by a liquid dredging material, the winch with its motor and its cables are soiled by the dredging material, because of which the operation of the crane can be endangered. The object of the invention is providing a crane of the type mentioned in the preamble, with which the winch with its cables and operating mechanism is protected in such a way, that they cannot be soiled by dredging material, because of which their operation is always guaranteed.

This object is reached according to the invention, in that the winch with its motor are housed inside a closed, tube-shaped part of the carrying arm, whereas the winch cables also extend at least partly through the tube-shaped carrying arm.

By the application of the invention there is reached, that the winch with its motor and its cables are housed protectedly inside the carrying arm of the crane, by means of which the safety of operation of this auxiliary machine is guaranteed.

According to a preferred embodiment of the invention the winch motor is placed coaxially on the inside of the winch. This gives a compact construction of which the operation is safe, which construction can easily be housed inside the tube-shaped carrying arm.

The invention will now be elucidated by means of the accompanying drawing of an embodiment.

Figure 1:
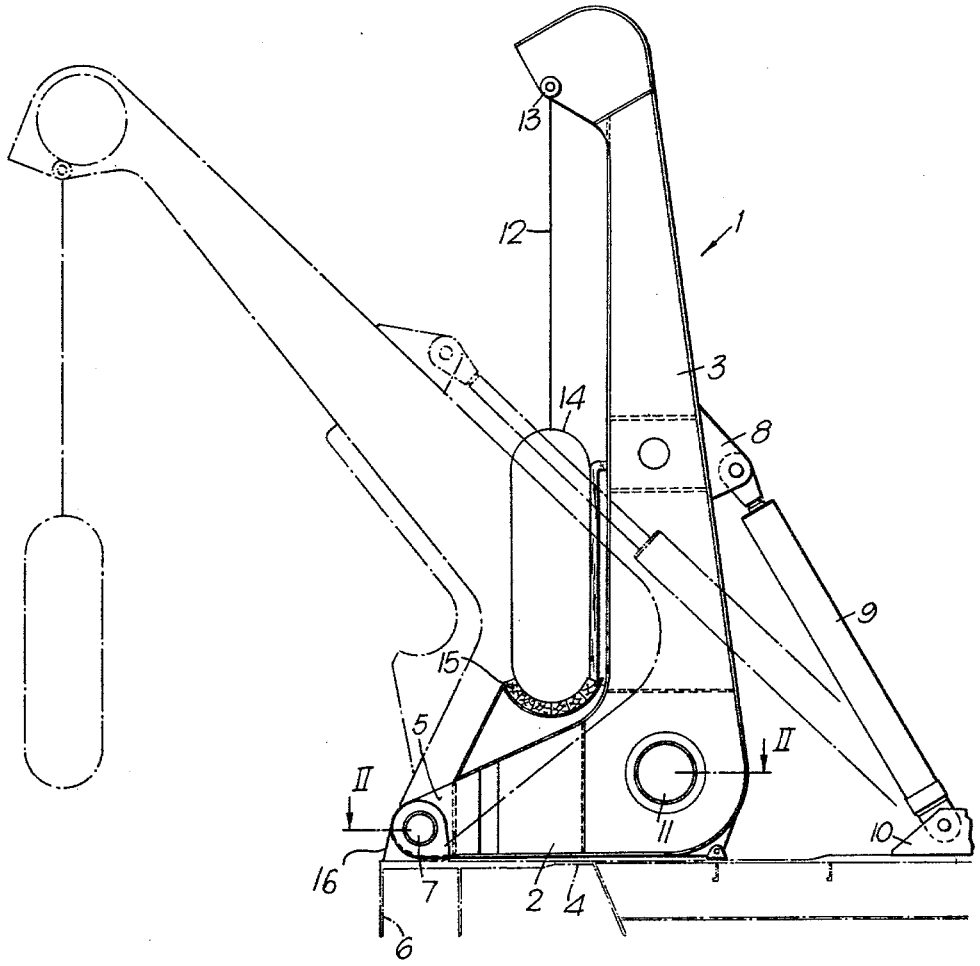
FIG. 1 shows a side view of a crane according to the invention, with which the rest position is shown with solid lines and the operating position with interrupted lines.

According to the drawing the crane according to the invention is provided with a carrying arm, that is generally indicated with 1, said carrying arm having in side view the shape of an L, that is composed from a substantially horizontal leg 2 and a substantially vertical leg 3. The horizontal leg 2 rests in the rest position on the deck 4 and is provided on its outside end with a pivot connection 5, that can pivot near the board 6 of the (partly shown) craft around an axis 7 extending in longitudinal direction of the craft. The substantially vertical leg 3 of the L has at about half of the height a pivot connection 8 for an operating mechanism 9, with which the crane can be displaced between its inboard position, shown with solid lines, and its outboard operating or dredging position shown with interrupted lines. The operating mechanism 9, that is preferrably a hydraulic piston-cylinder unit, has been connected with the one end on the pivot connection 8 of the vertical leg 3 of the L. The other end of the operating mechanism 9 is connected with a pivot connection 10 that is fixedly mounted on the deck 4 at some distance from the crane and lies in the plane thereof.

The carrying arm 1 is executed as a closed tube construction with rectangular cross section, with which the winch 11 is placed in the corner of the L-shaped carrying arm 1. Inside the winch and coaxially therewith a hydraulic drive motor is mounted.

Figure 2:
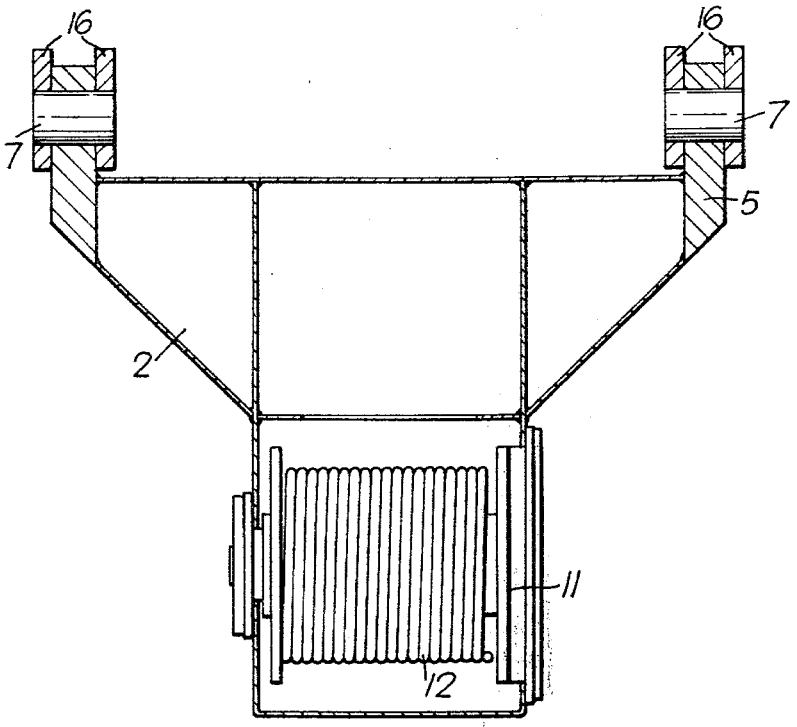
FIG. 2 shows a horizontal cross section over the line II—II in FIG. 1.

From the winch 11 extends a support cable 12 which leaves the carrying arm at a guide disc 13. The support cable 12 is connected with the tube part 14, that rests in the non-operative or rest position, shown with solid lines, in the tube chair 15. This chair 15 is arranged in the corner of the L against the outboard side of the carrying arm. The pivot construction 5, 7, which is most clearly visible in FIG. 2, shows the ears 5 that are fastened at the bottom side of the horizontal leg 2, at both sides of this leg and parallel to each other. These ears 5 extend between the ears 16 which are mounted on deck, whereas through the holes in both ears the pivot shafts 7 are inserted.

The invention is not limited to the shown and described embodiment but covers all variations thereof.

I claim:

1. A crane for a towing suction device of a dredging craft for displacing a movable part of the suction device between an inboard, rest position and an outboard, dredging position, said crane including: a generally L-shaped carrying member having a shorter leg that is substantially horizontal when said crane is in the rest position and a longer substantially vertical leg, said shorter leg resting on the deck of the dredging craft and having at its outboard end a pivot connection to the deck near the board of the craft with an axis extending in the longitudinal direction of the craft, said longer leg being formed as a closed tube shaped element; a winch and drive motor mounted within the tube shaped element in the corner of the L-shaped carrying member; winch cables extending through said tube shaped element from said winch to the movable part of the suction device; and means for pivoting said carrying member about said pivot to move the towing suction device between the inboard and outboard positions.

2. Crane according to claim 1, comprising the winch motor being placed coaxially at the inside of the winch.

3. Crane according to claim 1 or 2, comprising the winch motor being a hydraulic motor.

4. Crane according to claim 1, comprising the substantially vertical leg of the L-shaped member having in the central portion thereof a pivot connection for an operating mechanism with which the crane can be displaced between its inboard and its outboard position.

5. Crane according to claim 4, comprising the operating mechanism being fastened with its one end at the pivot connection of the vertical leg of the L-shaped member and at its other end with a pivot connection being fastened fixedly on the deck at some distance from the crane and lying in the plane thereof.

6. Crane according to claim 4, comprising the operating mechanism being a hydraulic piston-cylinder unit.

7. Crane according to claim 1, comprising against the outboard side of the carrying element in the corner of the L a chair has been mounted for the movable part of the towing suction device in which chair this part can be placed in the rest or non-operative position.

* * * * *